US006349827B1

(12) United States Patent
Feder

(10) Patent No.: US 6,349,827 B1
(45) Date of Patent: Feb. 26, 2002

(54) VENDING AND STORAGE DEVICE FOR TOOLS

(75) Inventor: Emil Feder, Kassel (DE)

(73) Assignee: Drill-Organizer E. Feder, Visp (CH)

( * ) Notice: Subject to any disclaimer, the term of this patent is extended or adjusted under 35 U.S.C. 154(b) by 0 days.

(21) Appl. No.: 09/601,502

(22) PCT Filed: Feb. 12, 1999

(86) PCT No.: PCT/EP99/00929

§ 371 Date: Aug. 2, 2000

§ 102(e) Date: Aug. 2, 2000

(87) PCT Pub. No.: WO99/42255

PCT Pub. Date: Aug. 26, 1999

(30) Foreign Application Priority Data

Feb. 18, 1998 (DE) ..... 298 02 752 U

(51) Int. Cl.[7] ..... B65D 85/24

(52) U.S. Cl. ..... 206/373; 206/379; 206/443; 211/69; 211/70.6

(58) Field of Search ..... 206/369, 371–379, 206/443, 459.5; 211/69, 70.6

(56) References Cited

U.S. PATENT DOCUMENTS

| | | | | |
|---|---|---|---|---|
| 1,341,848 A | | 6/1920 | Haensler | |
| 3,276,847 A | * | 10/1966 | Duff et al. | 206/373 |
| 3,583,556 A | * | 6/1971 | Wagner | 206/373 |
| 5,344,012 A | * | 9/1994 | Matthews | 206/372 |
| 5,398,810 A | * | 3/1995 | Yao Wang | 206/373 |
| 5,628,400 A | | 5/1997 | Feder | |
| 5,845,774 A | * | 12/1998 | Hausknecht | 206/379 |

FOREIGN PATENT DOCUMENTS

| | | |
|---|---|---|
| DE | 85 34 009.5 | 2/1986 |
| DE | 88 00 520 | 3/1988 |
| EP | 0 311 789 | 4/1989 |
| WO | WO 94/23909 | 10/1994 |

OTHER PUBLICATIONS

International Search Report prepared by EPO dated Jul. 2, 1999.

* cited by examiner

*Primary Examiner*—Luan K. Bui
(74) *Attorney, Agent, or Firm*—Merchant & Gould P.C.

(57) ABSTRACT

The invention relates to a vending and storage device (1) for tools, comprising a support device for tools having a cylindrical shaft with differing sizes and arranged in rows in locating slots (8). An elongated precision measuring channel (3*a*, 3*b*, 3*c*) is allocated and arranged parallel to said slots (8). A measuring gage (5) formed by stop bodies (6, 2) is allocated to each locating slot (8) in or on the precision measuring channel (3*a*, 3*b*, 3*c*). Several precision measuring channels (3*a*, 3*b*, 3*c*) are arranged in a substantially parallel manner in the support device. Said channels lead to a rough measuring channel (4) with measuring gages (5) extending along the front face of the precision measuring channels (3*a*, 3*b*, 3*c*) at a right angle therefrom. Several locating slots (8*a*, 8*b*, 8*c*) for tools having the same diameter are allocated to at least the precision measuring channels (3*a*, 3*b*, 3*c*).

15 Claims, 2 Drawing Sheets

Figure 1:
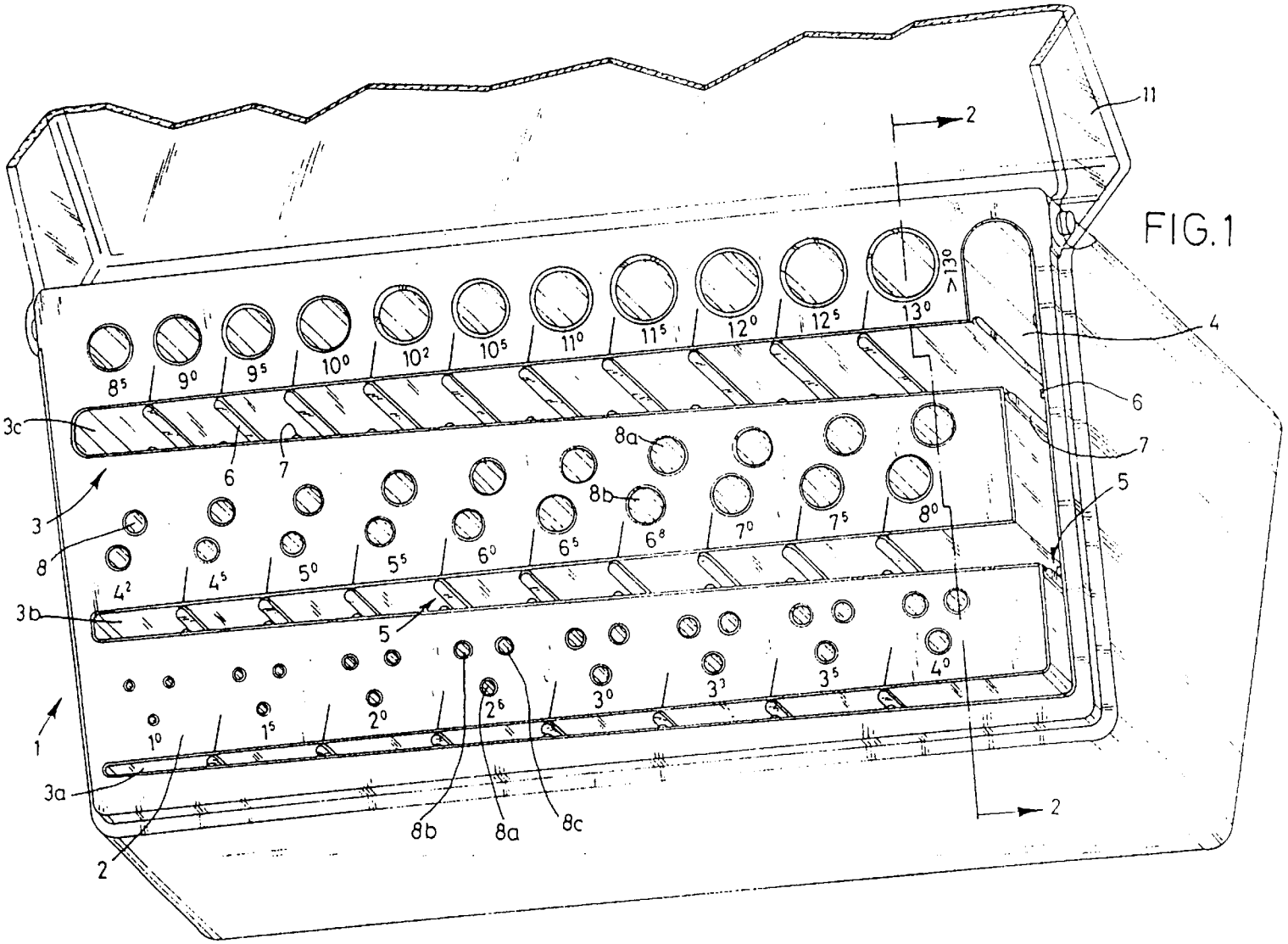

11
4
6
7
5
2
2
>130
13°
12⁵
12°
11⁵
11°
10⁵
10²
10°
9⁵
9°
8⁵
8°
7⁵
7°
6⁸
6⁵
6°
5⁵
5°
4⁵
4²
4°
3⁵
3³
3°
2⁶
2°
1⁵
1°
8a
8b
8c
8a
8b
5
7
6
3c
3
8
3b
1
3a
2

VENDING AND STORAGE DEVICE FOR TOOLS

The invention relates to a sales and storage device according to the preamble of the main claim.

A device having the features of the preamble is known from EP 311 789 B1 and makes it possible for cylindrical workpieces to be reliably arranged in place quickly and without any great amount of care being required. This device has proven successful in practice.

WO-A 94 23 909 describes a sale and storage device for tools which has the features of the preamble of the main claim and further develops the device of the generic type according to EP 311 789 B1 in that the actual retaining device is formed by one housing part, e.g. a shell-like top housing part, and a further housing part, e.g. a base plate which can be secured on the first housing part, it being the case that the tubular-holder-like receiving holes, the precision measuring channels and the rough measuring channel as well as recesses for the stop bodies of the gauges are formed in the top housing part.

As a sales and storage device, however, it is necessary to ensure that, in particular with drill bits of smaller diameter, more than one drill bit is available since these drill bits break quickly, with the result that in a workshop, despite damage or loss of a drill bit, a further drill bit is quickly available. In particular for professional concerns, it is also sought, when a set of drill bits is purchased, to have a larger number of the drill bits of smaller diameter than the drill bits of larger diameter since experience has shown that there is a considerably greater need for purchasing further drill bits of smaller diameter.

The object of the invention is to provide a sales and storage device for tools, in particular drill bits, which, as early as the purchase stage, takes into account the fact that drill bits of smaller diameter are used up more quickly, and thus have to be provided in larger numbers, and which makes it possible for the user to be provided, during usage of the storage device, with a larger number of precisely those drill bits which are subject to quicker wear or are more likely to rupture.

This object, on which the invention is based, is achieved by the teaching of the main claim.

Further configurations are explained in the subclaims.

In other words, it is proposed that the drill-bit-receiving device has a covering plate which is provided with precision measuring channels and a rough measuring channel, it being the case that the precision measuring channels and the rough measuring channel have, in a manner known per se, gauges which are assigned to the respective receiving hole, but the precision measuring channels for the smaller tool diameters, i.e. smaller drill-bit diameters, are assigned a plurality of receiving holes for said tools of the same diameter, with the result that, for example, the drill-bit diameter of "1 mm" is assigned three receiving holes. The second precision measuring channel, which is assigned, for example, the tool diameters of from 4.2 mm to 8 mm, is assigned two receiving holes for each tool diameter which, if the device is of appropriately large design, may also be the case with the third measuring channel, although this, in principle, is not as important since the thicker drill bits break less frequently and are subject to less pronounced wear.

According to the invention, it is also provided that the receiving holes in the actual covering plate of the device are adjoined by tubular holders which are designed with solid walls over most of their length and preferably merge into the covering plate in the top region by way of the bevel or rounded formation. It is also provided that these tubular holders have, in the top region, an internal diameter which is larger than the nominal diameter of the tool and, in the bottom region, an internal diameter which, although larger than the nominal diameter, is smaller than the internal diameter in the top region. These measures make it possible for a drill bit to be introduced quickly into the tubular holder via the bevel in the covering plate.

Since the tubular holder is designed with solid walls over most of its length, good guidance is provided here with the drill-bit end, with the result that tilting of the drill bit is avoided. Should burr, caused by the securing device in the drill, project on the outside of the drill bit, the larger internal diameters of the tubular holders mean that the drill bit is nevertheless inserted satisfactorily here into the associated receiving hole and/or into the associated tubular holder.

The entire device may be produced, for example injection molded, from plastic, but can also be produced from metal and, finally, it appears advantageous for said device also to be produced from a combination of metal and plastic.

Figure 2:
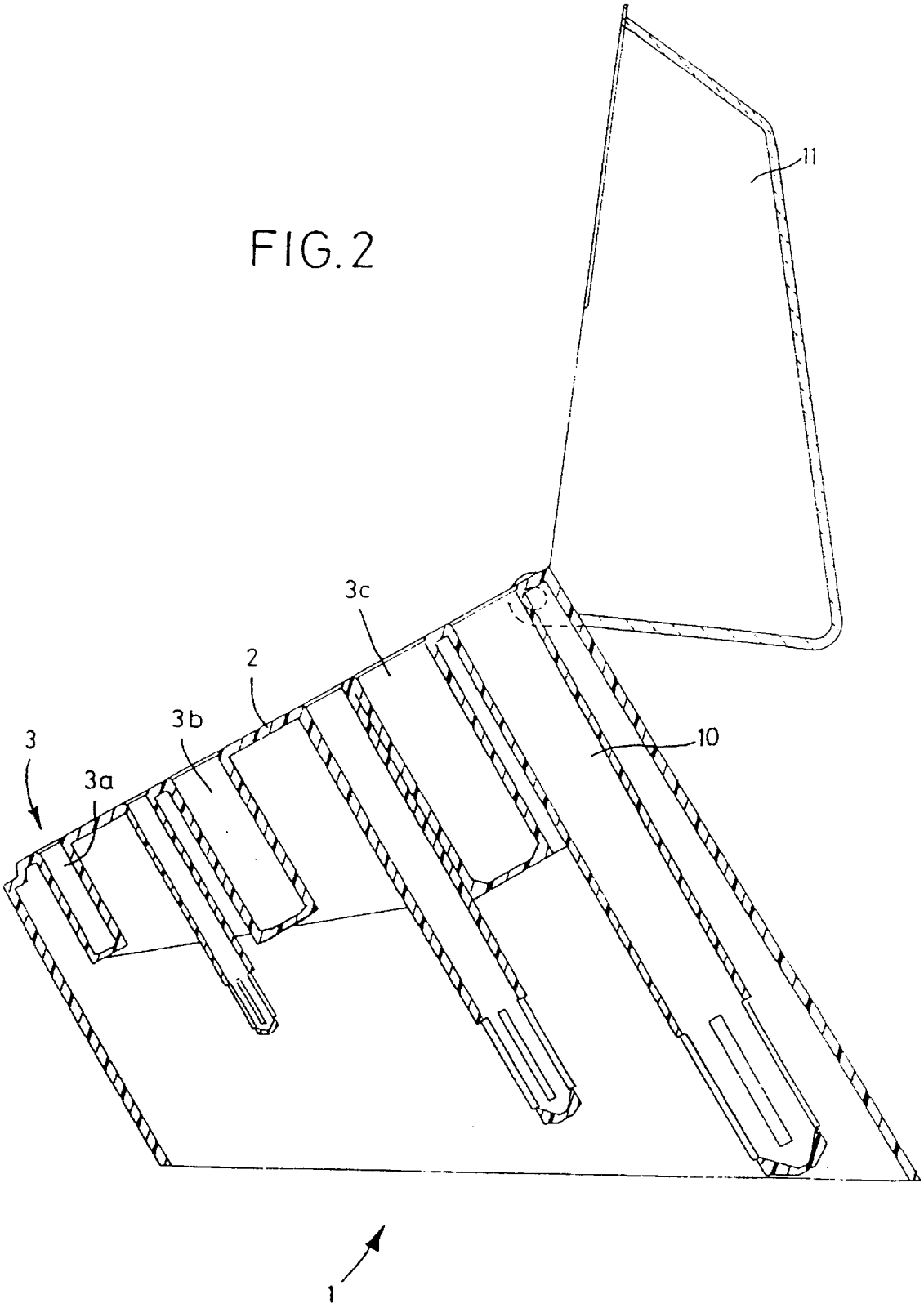

An exemplary embodiment of the invention is explained hereinbelow with reference to the drawings, in which:

FIG. 1 shows, diagrammatically, a view of the top side of the sales and storage device according to the invention, and FIG. 2 shows a section along line 2—2 in FIG. 1.

The drawings illustrate a sales and storage device 1 with a lid 11. The lid 11 may preferably be produced from transparent plastic, with the result that it is possible at any time to monitor the correct contents of the sales and storage device 1. The height of the sales and storage device 1 is adapted to the largest drill bit or the largest cylindrical tool which is to be received. The lid 11 is preferably designed such that it can easily be removed, to be precise such that it can be removed intact, with the result that it is possible for the lid to be removed when the sales and storage device 1 is accommodated, for example, in a drawer. If the sales and storage device 1 stands in the open, the lid has the effect of protecting the contents and also of preventing catching, for example with the sleeve of an overall.

As the drawing clearly shows, the sales and storage device 1 is of ergonometrically favorable form in that it is designed to be inclined in the forward direction, this ensuring good access to the individual tools.

While the drawing illustrates the walls of the sales and storage device 1 as being solid, it is, of course, also possible for said wall surfaces to have through-passages or merely for supports to be provided in the corner regions, with the result that, although the same stability is thus achieved, the amount of plastic used is reduced at the same time.

The sales and storage device 1 is preferably produced in a single piece—e.g. by injection molding—as is the lid 11, which can then be connected to the sales and storage device 1.

The sales and storage device 1 has a covering plate 2 which may consist, for example, of plastic and in which precision measuring channels 3 are provided, three precision measuring channels 3*a*, 3*b* and 3*c* being provided in the exemplary embodiment illustrated. Provided in said precision measuring channels 3*a*, 3*b* and 3*c* are gauges 5 which are formed by stop bodies 6, 7, each gauge 5 being assigned one or more receiving holes 8. As can be seen from FIG. 1 of the drawing, a rough measuring channel 4 is also provided, this, likewise formed by stop bodies 6, 7, having gauges 5 which are assigned to the precision measuring channels 3*a*, 3*b* and 3*c*, with the result that, by virtue of the tool which is to be inserted being introduced into the rough measuring channel 4, it can be gauged automatically in which precision measuring channel 3*a*, 3*b* or 3*c* the tool has to be arranged in place, in which case, in the precision measuring channel, for example 3*b*, said cylindrical tool can then be assigned, by the gauges 5 provided in said channel, to the associated receiving holes 8 and then, by being removed from the precision measuring channel 3, can be introduced into the associated receiving hole 8.

As can be gathered from the drawing, the receiving holes 8 are adjoined by tubular holders 10 which are designed with solid walls over most of their length and may have a larger internal diameter in the top region than in the bottom region, for example the internal diameter in the top region being 0.5 mm larger than the nominal diameter of the receiving hole 8 and, in the bottom region, the internal diameter being approximately 0.2 mm larger than the nominal diameter of the receiving hole 8. It can be seen in FIG. 2 that the tubular holders 10 are designed with solid walls over most of their length. In the illustration according to FIG. 2, it is only in the bottom region that they are provided with slits. In the same way, however, it is also possible for the tubular holders to be produced by grille-like strips running in the longitudinal direction of the tubular holders, it being the case here, in turn, that there is a reduction in the amount of plastic material used during the production of the sales and storage device 1 but, on the other hand, good guidance of the drill bit is ensured at the same time and, finally, the weight of the device can be reduced correspondingly. The transition from the covering plate 2 into the receiving hole 8 and thus into the tubular holder 10 is beveled, rounded or chamfered, this resulting in a funnel-like configuration which facilitates the introduction of the cylindrical tool into the associated receiving hole 8 and the associated tubular holder 10.

The figures also show that, in the precision measuring channels 3*a* and 3*b*, it is not the case that each gauge is assigned just one receiving hole 8, as is the case with the illustration of the precision measuring channel 3*c*, but rather the precision measuring channels 3*a* and 3*b* are each assigned a plurality of receiving holes, that is to say, for example, the precision measuring channel 3*a* is assigned three receiving holes 8*a*, 8*b*, 8*c* and the precision channel 3b is assigned just two receiving holes 8*a* and 8*b* for one drill-bit size. This gives a larger supply and, when the cylindrical tools, e.g. the drill bits, are purchased, takes immediate account of which drill bits are subject to greater wear or are likely to be destroyed or lost.

According to the invention, the sales and storage device thus serves, on the one hand, as packaging for selling the cylindrical tools and, on the other hand, as a means for arranging the same in an orderly manner as work is carried out, for example using drill bits.

What is claimed is:

1. A sales and storage device for tools comprising a retaining device having holes arranged in a plurality of rows for receiving cylindrical-shank tools of different dimensions, wherein at least one of the holes is equal in diameter to another of the holes in the same row, and wherein for each row of holes, a corresponding elongate precision measuring channel serving as a precision guide is assigned to and arranged in parallel with said row of holes, wherein the precision measuring channels are arranged essentially parallel to one another and open out into a rough measuring channel which runs at a right angle to the precision measuring channels, and wherein the precision measuring channels comprise a plurality of varying-sized stop bodies associated with the diameters of the corresponding receving holes.

2. The device as claimed in claim 1, wherein a precision measuring channel is assigned three receiving holes for tools of the same diameter.

3. The device as claimed in claim 1, wherein a precision measuring channel is assigned two receiving holes for tools of the same diameter.

4. The device as claimed in claim 1, wherein the receiving holes are provided in a covering plate and are adjoined by tubular holders which have solid walls over most of their length.

5. The device as claimed in claim 1, wherein the receiving holes are provided in a covering plate and are adjoined by tubular holders which are formed from strips running in the longitudinal direction of the tubular holders and thus provide good guidance for the drill bits.

6. The device as claimed in claim 1, wherein the sales and storage device is produced integrally in a single piece.

7. The device as claimed in claim 4, wherein the tubular holders have, in the top region—in the region of the receiving hole—an internal diameter which is approximately 0.5 mm larger than the nominal diameter of the associated receiving hole and, in the bottom region, an internal diameter which is approximately 0.2 mm greater than the nominal diameter of the receiving hole.

8. The device as claimed in claim 4, wherein a transition from the covering plate into the tubular holder at each receiving hole is beveled slightly.

9. The device as claimed in claim 1, wherein the device consists of plastic.

10. The device as claimed in claim 1, wherein the device consists of metal.

11. The device as claimed in claim 1, wherein the device is produced from a combination of metal and plastic.

12. The device as claimed in claim 1, further comprising a lid, wherein the lid is produced from transparent plastic.

13. The device as claimed in claim 12, wherein the lid is designed such that it can be easily removed from the main body of the sales and storage device and easily attached to the sales and storage device.

14. The device as claimed in claim 5, wherein the tubular holders have, in the top region—in the region of the receiving hole—an internal diameter which is approximately 0.5 mm larger than the nominal diameter of the associated receiving hole and, in the bottom region, an internal diameter which is approximately 0.2 mm greater than the nominal diameter of the receiving hole.

15. The device as claimed in claim 5, wherein the transition from the covering plate into the tubular holder at each receiving hole is beveled slightly.

* * * * *